US008176979B2

(12) United States Patent
Ollre

(10) Patent No.: US 8,176,979 B2
(45) Date of Patent: May 15, 2012

(54) INJECTION WELL SURVEILLANCE SYSTEM

(75) Inventor: Albert G. Ollre, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 13 days.

(21) Appl. No.: 12/332,997

(22) Filed: Dec. 11, 2008

(65) Prior Publication Data

US 2010/0147511 A1 Jun. 17, 2010

(51) Int. Cl.
*E21B 43/12* (2006.01)

(52) U.S. Cl. ..... 166/250.01; 166/250.15; 166/305.1

(58) Field of Classification Search ..... 166/250.01, 166/250.15, 53
See application file for complete search history.

(56) References Cited

U.S. PATENT DOCUMENTS

| | | | | |
|---|---|---|---|---|
| 3,718,187 | A * | 2/1973 | Milton, Jr. | 166/270.1 |
| 4,685,522 | A * | 8/1987 | Dixon et al. | 166/372 |
| 4,805,697 | A * | 2/1989 | Fouillout et al. | 166/265 |
| 5,131,472 | A * | 7/1992 | Dees et al. | 166/308.1 |
| 5,442,173 | A | 8/1995 | Wraight | |
| 5,706,896 | A * | 1/1998 | Tubel et al. | 166/313 |
| 5,730,871 | A * | 3/1998 | Kennedy et al. | 166/265 |
| 5,992,519 | A | 11/1999 | Ramakrishnan et al. | |
| 5,996,690 | A * | 12/1999 | Shaw et al. | 166/250.01 |
| 6,017,456 | A * | 1/2000 | Kennedy et al. | 166/265 |
| 6,356,205 | B1 * | 3/2002 | Salvo et al. | 340/853.3 |
| 6,668,922 | B2 * | 12/2003 | Ziauddin et al. | 166/250.05 |
| 6,873,267 | B1 * | 3/2005 | Tubel et al. | 340/853.3 |
| 6,966,234 | B2 | 11/2005 | Carnegie et al. | |
| 7,096,092 | B1 * | 8/2006 | Ramakrishnan et al. | 700/281 |
| 7,261,162 | B2 | 8/2007 | Deans et al. | |
| 7,357,179 | B2 | 4/2008 | Zheng et al. | |
| 7,617,873 | B2 * | 11/2009 | Lovell et al. | 166/305.1 |
| 2002/0027004 | A1 * | 3/2002 | Bussear et al. | 166/250.15 |
| 2005/0150287 | A1 | 7/2005 | Carnegie et al. | |
| 2006/0090892 | A1 * | 5/2006 | Wetzel et al. | 166/250.01 |
| 2007/0175633 | A1 | 8/2007 | Kosmala et al. | |
| 2007/0252717 | A1 | 11/2007 | Fielder | |
| 2008/0236821 | A1 * | 10/2008 | Fielder | 166/265 |

FOREIGN PATENT DOCUMENTS

GB 2287093 A 9/1995

(Continued)

OTHER PUBLICATIONS

"The Nuts and Bolts of Falloff Testing" by Johnson & Lopez, published Mar. 5, 2003 by the EPA. pp. 68-71.*

*Primary Examiner* — David Bagnell
*Assistant Examiner* — Blake Michener
(74) *Attorney, Agent, or Firm* — Jim Patterson

(57) ABSTRACT

A method and apparatus for surveying a well in real-time and responding to operational conditions in response to the surveillance. According to one or more aspects of the present disclosure a method for surveillance of a well includes providing a producing a fluid from the formation into the wellbore, injecting a fraction of the fluid from the wellbore into an injection zone of the formation via operation of a pumping system. Well data is sensed in the wellbore proximate to the injection zone and a formation injection performance parameter is determined using the sensed well data. The formation injection performance parameter comprises one selected from the group of stable injection, negative skin, positive skin and water channeling.

20 Claims, 5 Drawing Sheets

FOREIGN PATENT DOCUMENTS

| | | | |
|---|---|---|---|
| GB | 2406238 | A | 3/2005 |
| GB | 2408758 | A | 6/2005 |
| GB | 2434646 | A | 8/2007 |
| WO | 2006048841 | A1 | 5/2006 |
| WO | 2007085783 | A1 | 8/2007 |
| WO | 2007086004 | A1 | 8/2007 |
| WO | 2007107815 | A1 | 9/2007 |
| WO | 2008055211 | A2 | 5/2008 |
| WO | 2008055211 | A3 | 6/2008 |
| WO | 2008055211 | B1 | 7/2008 |
| WO | 2009026357 | A2 | 2/2009 |

* cited by examiner

INJECTION WELL SURVEILLANCE SYSTEM

TECHNICAL FIELD

The present application relates in general to well systems and more particularly to injection wells.

BACKGROUND

It is often desired to inject a fluid into a subterranean geological formation. With reference to hydrocarbon operations it is often desired to dispose of the produced water through reinjection and/or to inject a fluid, typically water, as a method of tertiary hydrocarbon production. Typically, the injection fluid is pumped from the surface of the well, through the well and into the geological formation. For example, reservoir fluid is produced from the well to the surface. The produced fluid is separated into the primarily hydrocarbon fractions, or phases, and a primarily water fraction. It may be necessary to chemically treat the water fraction to make it again compatible with the reservoir formation. The water fraction is then injected into the reservoir formation via the wellbore. To monitor and control the water injection, data such as pressure and flow rate are obtained at the surface (wellhead). This process of injecting is often inefficient and the manner of monitoring the injection of fluids is often inaccurate.

SUMMARY

One embodiment of a method includes the steps of operating a pump disposed in a wellbore to inject a fluid into a formation penetrated by the wellbore; obtaining a well parameter in real-time; and outputting a signal in response to a correlation of the well parameter and a preselected threshold parameter.

An embodiment of a method for surveillance of a well includes the steps of providing a pumping system in a wellbore that penetrates a formation; producing a fluid from the formation into the wellbore; injecting a fraction of the fluid from the wellbore into the formation via operation of the pumping system; surveying the pumping system in real-time via a sensor that senses well data; determining in real-time the correlation of a well parameter with a preselected threshold well parameter, wherein the well parameter is related to the sensed well data; and outputting a signal in response to the well parameter exceeding the preselected threshold parameter. The method may further include separating, in the wellbore, the fluid into a primarily oil fraction and a primarily water fraction, wherein the primarily water fraction is the fraction of the fluid injected into the formation by an electric submersible pump system of the pump system. The method may also include the step of producing the primarily oil fraction of the fluid from the wellbore by a second pump of the pump system. In some embodiments, the well parameter may be derived from the sensed well data and the well parameter may be an injectability parameter. The well data may be sensed in the wellbore, proximate to the formation zone in which the fluid is injected.

An embodiment of an injection well surveillance system includes a wellbore penetrating a formation; a fluid separation system disposed in the wellbore, the system separating a primarily oil fraction and a primarily water fraction from a fluid produced from a producing zone of the formation into the wellbore; a pump system disposed in the wellbore, the pump system including an injection pump injecting the primarily water fraction into an injection zone of the formation; a sensor disposed in the wellbore, the sensor sensing well data; and a control center to receive the sensed well data and to output a signal in response to a correlation of a well parameter associated with the sensed well data and a threshold well parameter.

The foregoing has outlined some of the features and technical advantages of the present application in order that the detailed description that follows may be better understood. Additional features and advantages will be described hereinafter which form the subject of the claims.

BRIEF DESCRIPTION OF THE DRAWINGS

The foregoing and other features and aspects will be best understood with reference to the following detailed description of a specific embodiment, when read in conjunction with the accompanying drawings, wherein.

DETAILED DESCRIPTION

Figure 1:
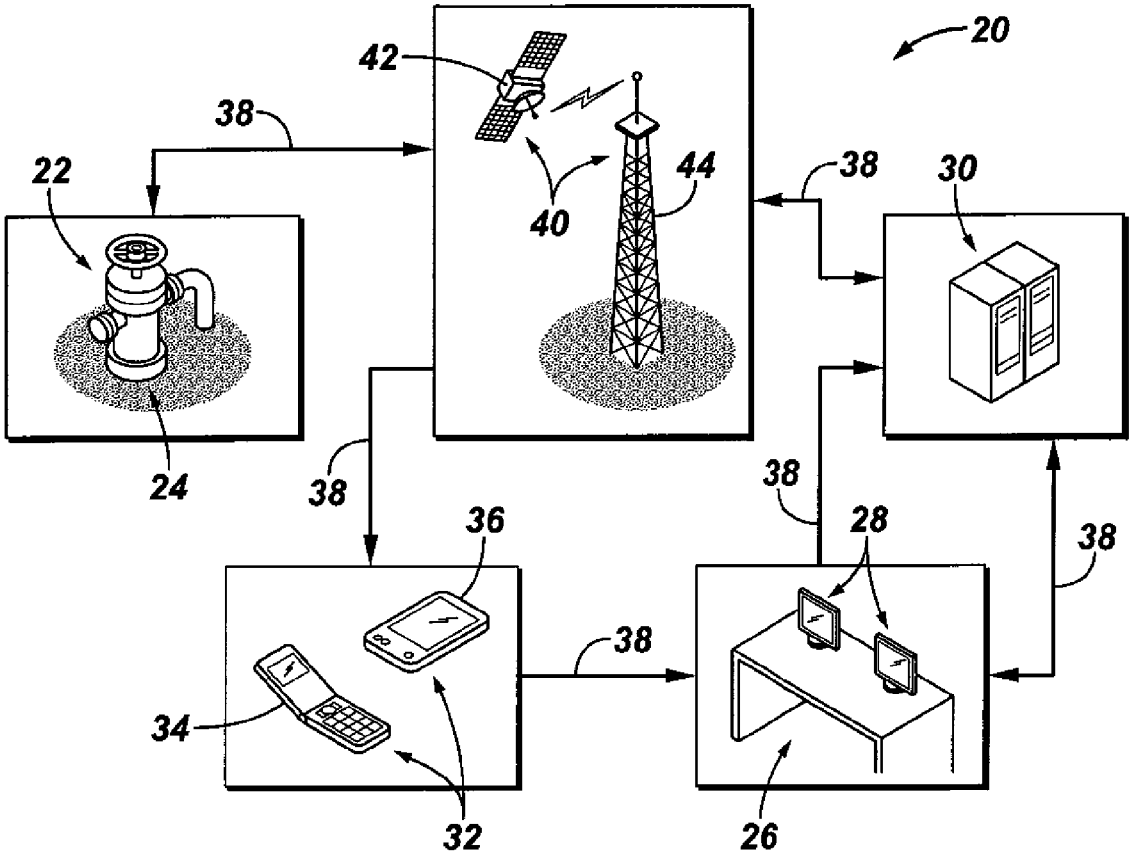
FIG. 1 is a schematic illustration of an embodiment of a well surveillance and control system.

Refer now to the drawings wherein depicted elements are not necessarily shown to scale and wherein like or similar elements are designated by the same reference numeral through the several views.

The present application generally relates to a system and method for remote real-time surveillance, control, and optimization of injection well systems. The devices, systems and methods described herein may enable a well operator or well field manager to better manage and optimize operation of one or more pumping systems without physically attending the wellsite. For example, the system and methodology enhances the monitoring, surveillance, diagnostics, and optimization of injection well systems using real-time and on-time data in a cost efficient manner.

Referring generally to FIG. 1, one embodiment of an injection well surveillance and control system 20 is illustrated. In this embodiment, a wellsite 22 comprises one or more pumping systems 24 (pumps), such as electric submersible pumps (ESP), for pumping fluid. In some embodiments, pumps 24 are used to inject fluids from the well into a geological formation surrounding the well. In some embodiments, pumps 24 are used to pump hydrocarbon-based fluids, e.g. oil, from geological formations beneath the surface of the Earth via the well.

Surveillance and control system 20 further comprises a remote control center 26 where surveillance data is obtained from wellsite 22 and pumping systems 24 on a real-time and on-time basis. Surveillance data may include, without limitation, data related to the well which may include surface and downhole parameters, such as pressure, temperature, fluid density, water cut of fluid, hydrocarbon fraction of fluids, fluid flow rates, pump speeds, pump temperatures, and the like.

Control center 26 may comprise one or more processor-based control systems 28, such as computer-based workstations where wellsite operators or managers can observe data obtained from wellsite 22 and pumping systems 24. This well data can be used for analysis, planning, and decision-making with respect to operation of pumping system 24 and the overall wellsite. Additionally, control systems 28 can be used to provide control instructions to wellsite 22 along with, for example, action updates, data polling, and queries.

Either at remote control center 26 or at another remote location, surveillance and control system 20 can include a data storage system 30 to retain data. Data storage system 30 also can be used to provide user security controls, alarm and alert management, business process management, and other functionality in cooperation with remote control center 26. For example, remote control center 26 and data storage system 30 enable a multidiscipline collaboration and historical interrogation of wellsite data to aid in diagnostic analysis and optimization of pumping system operation.

Control system 28 in cooperation with data storage system 30 also can be used to instigate alarms/alerts when real-time data or data trends indicate changes causing concern with respect to operation of pumping systems 24, e.g. movement of parameter values into a sub-optimal range or beyond a predetermined threshold value. The alerts can be provided at control system 28 and/or at a variety of other monitoring locations. For example, the alerts may be provided to remote handheld devices 32, such as cellular telephones 34 or personal digital assistants 36.

The two-way communication between wellsite 22 and the various remote locations, e.g. remote control center 26, data storage system 30, and remote handheld devices 32, is accomplished over a network 38. Network 38 can be established via a variety of transmission mechanisms, including wired and wireless mechanisms 40. For example, the two-way communication of data between wellsite 22 and the remote locations can be sent at least in part over the Internet. Portions of the network may be hardwired, may comprise satellites 42 for satellite transmission, may comprise cellular or radio towers 44 for wireless transfer, or may comprise a variety of other data transmission technologies for conveying data, including real-time data, between the wellsite 22 and the various remote locations of surveillance and control system 20.

Figure 2:
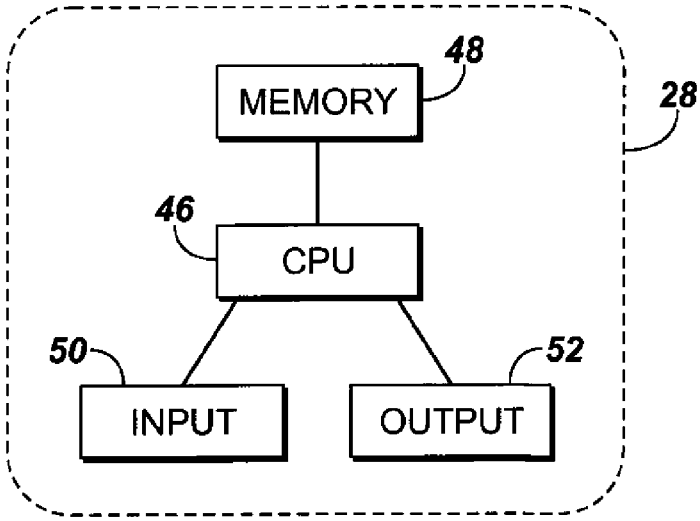
FIG. 2 is a diagrammatic illustration of an automated system that can be utilized to acquire and manipulate data, according to an embodiment.

Control system 28 is designed to automate processing of much of the data flow within surveillance and control system 20. In the present example, control system 28 is a computer-based system having a central processing unit (CPU) 46, as illustrated in FIG. 2. CPU 46 is a microprocessor based CPU for rapidly processing data obtained from wellsite 22, from data storage system 30, and/or from other locations coupled to remote control center 26 via network 38. Furthermore, CPU 46 is operatively coupled to a memory 48, as well as an input device 50 and an output device 52. Input device 50 may comprise a variety of devices, such as a keyboard, mouse, voice-recognition unit, touch screen, other input devices, or combinations of such devices. Output device 52 may comprise a visual and/or audio output device, such as a monitor having a graphical user interface. Additionally, the processing may be done on a single device or multiple devices.

Figure 3:
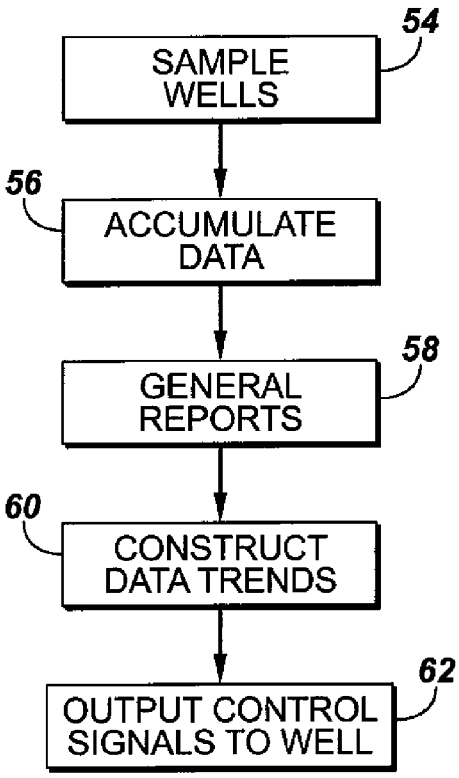
FIG. 3 is a flowchart of one embodiment of a method of utilizing the surveillance and control system.

As illustrated by the flowchart of FIG. 3, control system 28 and overall surveillance and control system 20 increase well management functionality while reducing costs by enabling easy use of real-time and historical data at any of a variety of locations remote from the managed wellsite. For example, surveillance and control system 20 enables the sampling of well-related parameters at individual wells within wellsite 22, as indicated by block 54. The system further promotes accumulation of this data at one or more remote sites, such as data storage system 30 and/or remote control center 26, as indicated by block 56. Control system 28 and CPU 46 enable the use of this well data to generate a variety of reports, as indicated by block 58. The reports can be used to aid analysis, planning, and decision-making regarding operation of wellsite 22. Additionally, the storage of data output over network 38 from wellsite 22 enables the construction of data trends, as indicated by block 60. The data trends, including those developed on a real-time basis, also aid in the analysis, planning, and decision-making that allows operation of the wellsite to be optimized. Based on the data output from pumping systems 24 and wellsite 22, the management of wellsite 22 can be accomplished from a variety of remote locations, such as remote control center 26. Also based on analysis of the well data, control signals can be output from remote devices, e.g. control system 28 or remote handheld devices 32, to wellsite 22, as indicated by block 62. The analysis can be automated analysis performed at control center 26.

Figure 4:
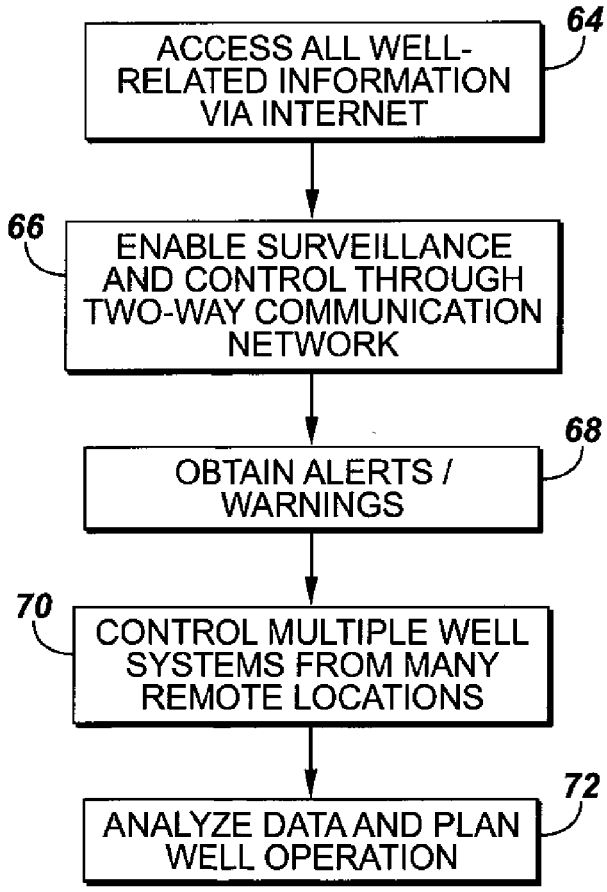
FIG. 4 is a flowchart of one embodiment of a method of utilizing the surveillance and control system to obtain well data in real-time and to utilize the data to optimize operation of the well system.

The use of communication tools, such as network 38, control system 28, remote handheld devices 32, data storage systems 30, and other potential devices coupled into network 38, enables a well operator to facilitate surveillance and optimization of well behavior without traveling to the specific wellsite. As illustrated in the flowchart of FIG. 4, the well operator can access all well-related information via network 38, as illustrated by block 64. In this embodiment, the well operator has access to all well-related information via the Internet. The well operator also can enable many approaches to surveillance and control from a variety of remote locations via the two-way communication network 38, as illustrated by block 66.

Figure 8:
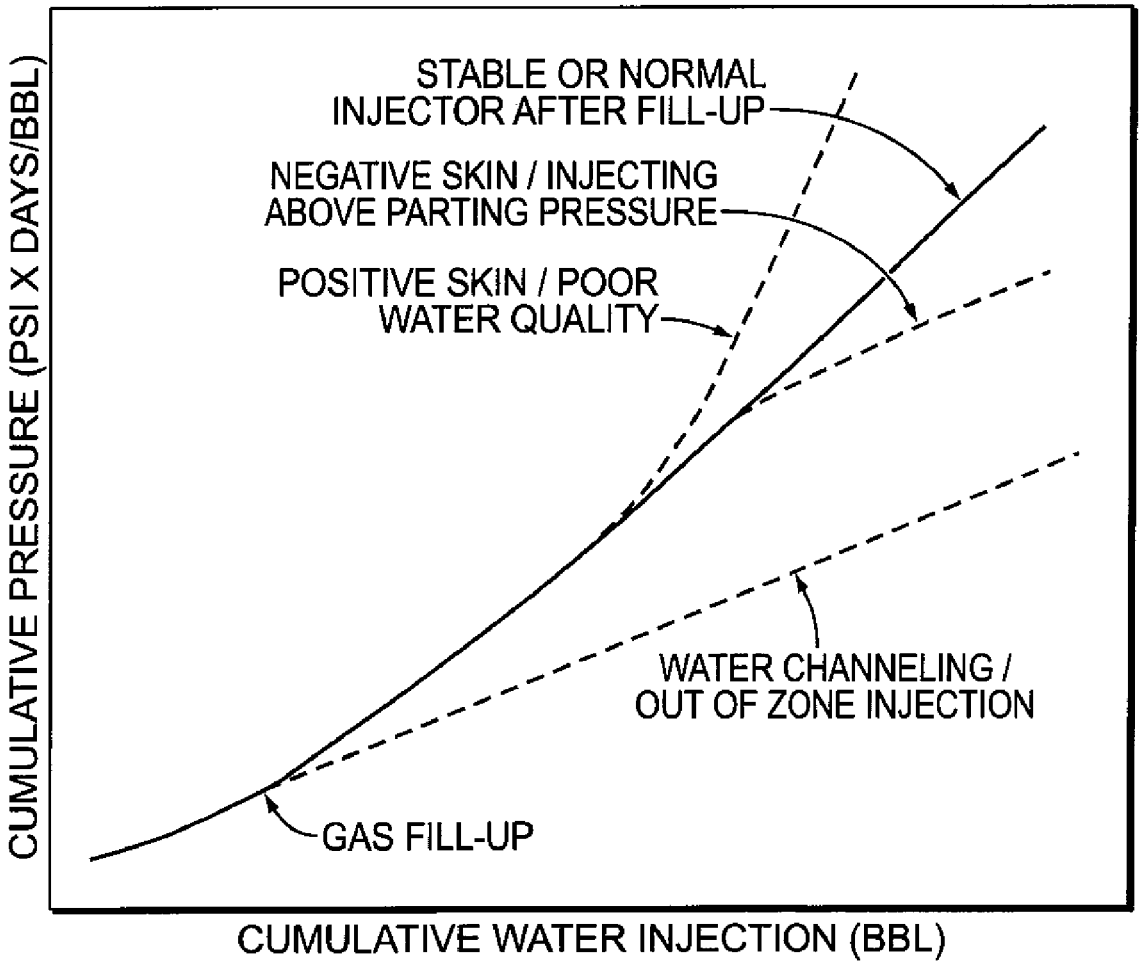
FIG. 8 is a graphical illustration of a Hall plot that can be derived and displayed from well data acquired, according to an embodiment.

Furthermore, the well operator can program control system 28 and CPU 46 to provide alerts/warnings when well-related parameters fall outside a desired range or cross a specific set point, as illustrated by block 68. For example, alerts may be communicated when input performance thresholds or set points, such as injectability parameters of the Hall plot of FIG. 8, are exceeded. In many applications, the set points can be changed by sending appropriate control signals to wellsite 22 from a remote location, e.g. from remote control center 26 or from remote handheld devices 32. The use of network 38 also enables a well operator to control multiple well systems from one or more remote locations, as illustrated by block 70. Additionally, the storage of data by data storage system 30 and the processing of both real-time and historical data on control system 28 enable a wide variety of analyses to be performed by the well operator and/or others to better plan and optimize well operation, as illustrated by block 72. In some applications, the combination of real-time monitoring and data analysis, either automatic analysis at control center 26 or human analysis, ensures optimum performance of wellsite equipment, including electric pumping systems, variable speed drive controllers, multisensor artificial lift monitoring systems, and a variety of other components and systems.

Figure 5:
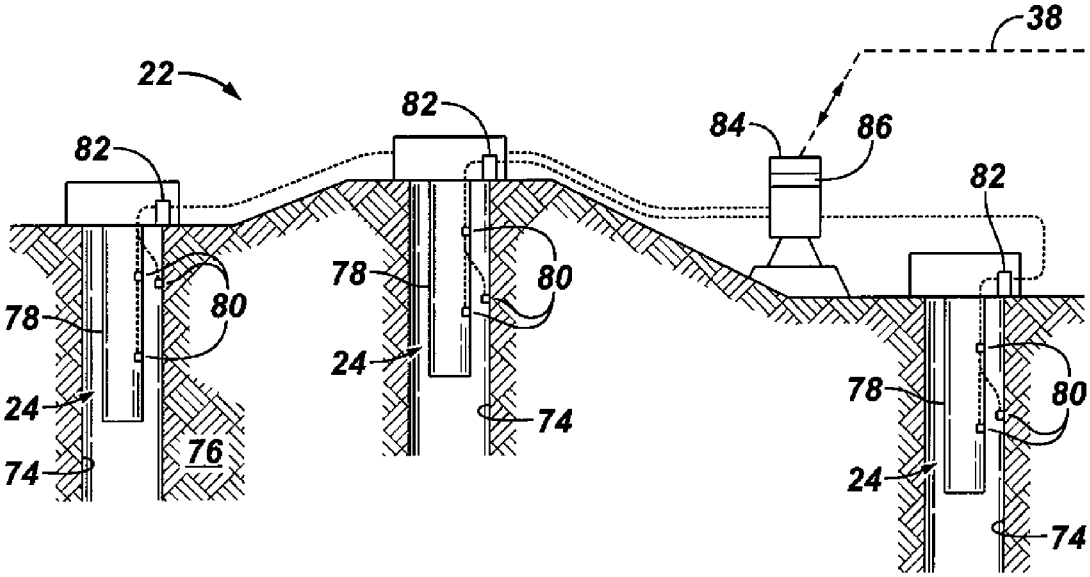
FIG. 5 is an elevation view of an embodiment of a wellsite including a plurality of wells deploying pumping systems.

One example of a wellsite 22 and wellsite equipment used in the injection and/or production of hydrocarbon-based fluids is illustrated in FIG. 5. In this embodiment, wellsite 22 comprises a plurality of wellbores 74 drilled in a formation 76. Within each wellbore 74, a pumping system 24, comprising an electric submersible pumping system 78, is deployed. Instrumentation, such as a plurality of sensor devices 80, is deployed with the pumping system 24 and may be internal to the pumping system, external to the pumping system, and/or disposed at separate locations within the wellbore 74. Examples of sensor devices 80 include pressure sensors, flow rate sensors, temperature sensors, e.g. distributed temperature sensors, vibration sensors, multisensors, voltage sensors, current sensors, and/or other sensors able to output signals corresponding to the measured parameter in real-time. Sensor devices 80 may sense data indicative of a well or wellbore parameter and/or sense data that may be analyzed and or manipulated to be indicative of a well parameter. For example, a sensor may sense injection pressure, the injection fluid flow rate, and elapsed injection time. These sensed parameters or data may be further analyzed, for example by system 28, and generate well parameters such as those associated with and indicative of injection performance and capability of the formation an illustrated by example in FIG. 8.

In addition to sensor devices 80 and other surveillance equipment, surveillance and control system 20 may comprise a variety of controllable devices 82 which regulate operation of injection well 74 and pumping system 24. Controllable devices 82 can be controlled remotely via control signals sent over network 38 from one or more remote locations, such as remote control center 26. One example of a controllable device 82 is a variable speed drive that can be controlled remotely and in operational connection with an electrical submersible pump 78. Controllable devices 82 may comprise a variety of other controllable devices that may be positioned at the surface and/or in the wellbore. For example, and without limitation, controllable devices may include downhole fluid separators 82*a* (FIG. 7), valves, heaters, and other components that may be used in cooperation with the electric submersible pumping systems 78. Each of the controllable devices 82 can respond to specific control instructions input at a remote location, e.g. control center 26.

Figure 6:
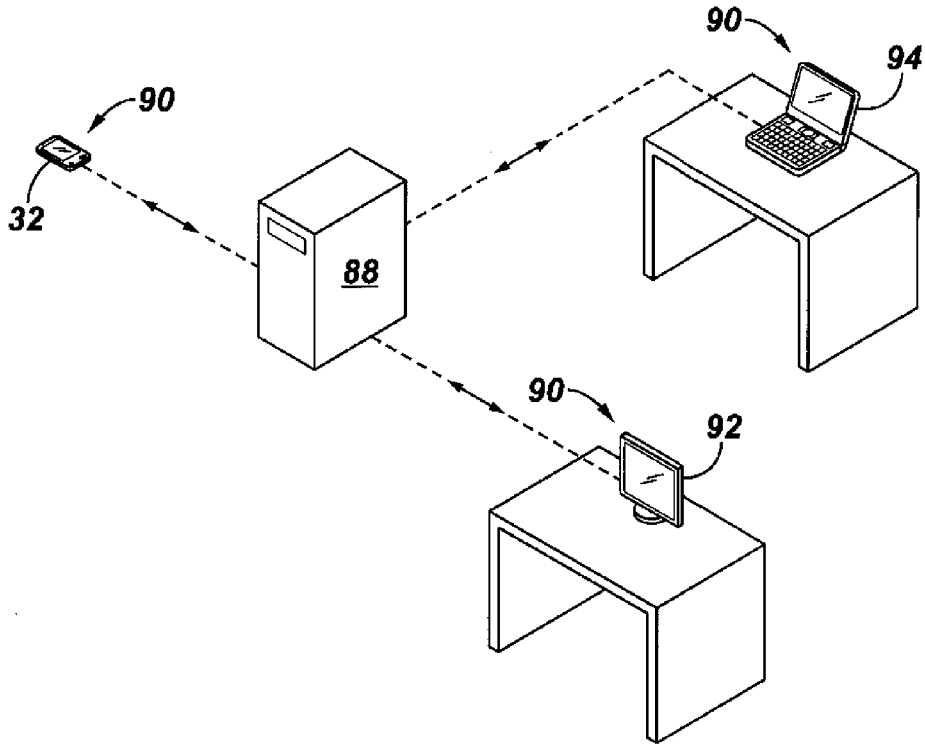
FIG. 6 is a schematic representation of an embodiment of network and remote observation and/or control station.

In the illustrated embodiment, controllable devices 82 e.g. pump controllers, valves, downhole separator, etc., and sensor devices 80, interface with a site communications box 84 which is used to relay signals between the various wellsite devices and network 38. By way of example, the site communications box 84 may comprise a satellite radio and process-assisted communicator 86 for relaying signals to and from satellite 42. The data from wellsite 22, for example, can be transferred to a remote management system 88 that provides Internet access to the data from a variety of Internet accessible remote locations 90, as illustrated in FIG. 6. The remote management system 88 may form part of remote control center 26, or remote management system 88 may be located separately. In the latter embodiment, control center 26 is coupled in communication with remote management system 88 via the Internet.

As illustrated in FIG. 6 and FIG. 1, the structure of network 38 can vary substantially. This flexibility greatly enhances the remote surveillance and control capabilities of system 20 with respect to electric submersible pumping systems 78 and other equipment at wellsite 22. Access to surveillance and/or control can be provided at numerous remote locations 90 and to numerous types of devices. For example, surveillance and control functionality may be provided to a computer-based workstation 92 at, for example, remote control center 26. However, surveillance and/or control capability can be provided to portable devices such as a laptop computer 94 and/or one or more types of portable handheld devices 32.

In one embodiment, surveillance and control system 20 comprises a web-based application that allows individuals to monitor and control equipment at one or more wellsites 22 from virtually anywhere in the world. In this embodiment, an operator requires only a web browser and an Internet connection to gain access at a variety of remote locations 90. With the use of, for example, a graphical user interface, the operator can simply click on-screen buttons and select drop-down menus to easily access any monitored and/or control points, as discussed more fully below. Of course, access to the system can be controlled by various security measures, including user profile permissions as set by, for example, a project supervisor.

Figure 7:
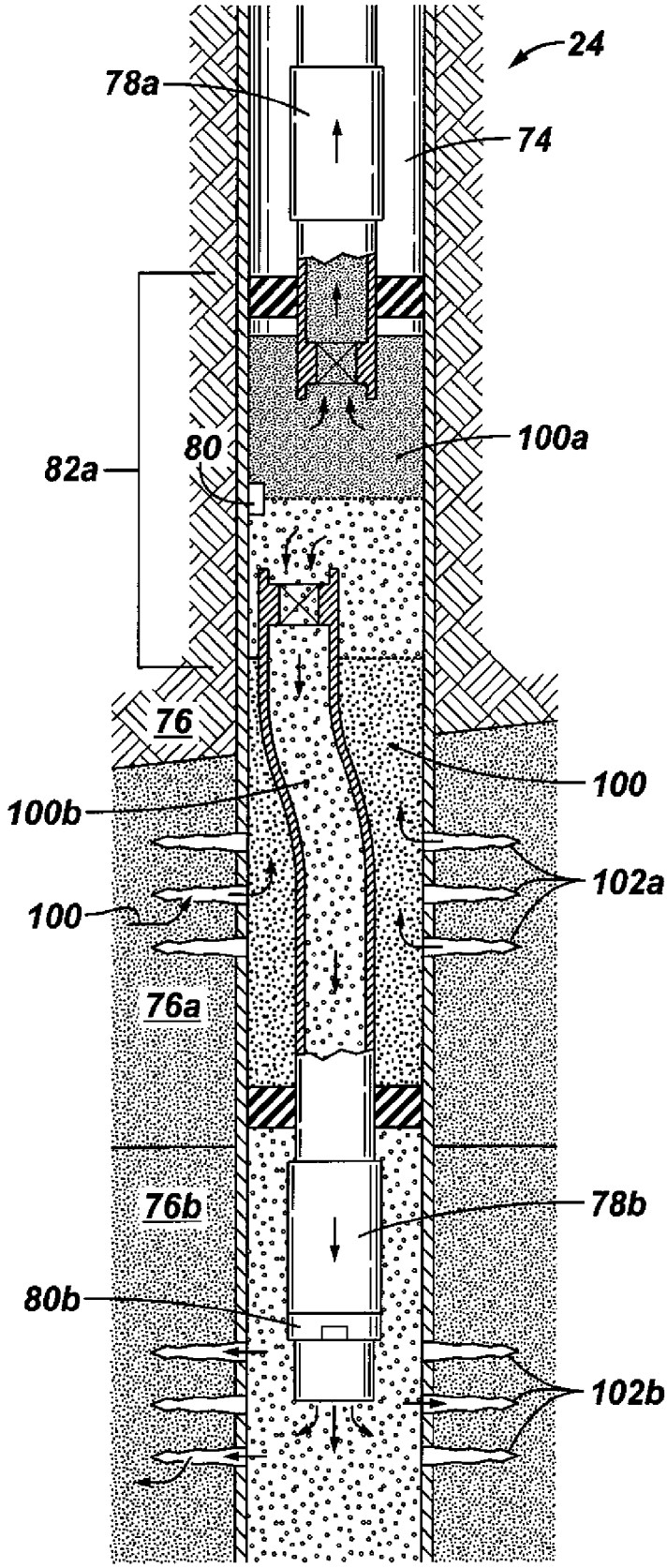
FIG. 7 is a schematic illustrating a well completed with a downhole fluid separator and a pump system adapted to inject a portion of the wellbore fluid and to produce a portion of the wellbore fluid to the surface.

Refer now to FIG. 7, wherein an embodiment of injection well 74 is illustrated. In the illustrated embodiment, pumping system 24 is adapted to pump a portion of wellbore fluid to the surface and a second portion of a wellbore fluid into a zone of geological formation 76. In this embodiment, formation fluid is produced from zone 76*a* through casing perforations 102*a* into wellbore 74 and is identified generally wellbore fluid 100. Although well or wellbore 74 is illustrated as a production and injection well, in other embodiments it may be either a production or an injection well.

Wellbore 74 is completed with a downhole separator, generally denoted by the numeral 82*a*, to promote the separation of fluid phases of wellbore fluid 100. In the illustrated embodiment, downhole separator 82*a* promotes separation of the wellbore fluid into a primarily oil phase 100*a* and a primarily water phase 100*b*. Downhole separator 82*a* may be provided in various configurations and may include sensors 80 and controllable elements 82, such as valves and the like. Some examples of downhole separator devices and systems are disclosed in U.S. Pat. No. 6,719,048 which is incorporated herein by reference.

In the illustrated embodiment of FIG. 7, pumping system 24 includes a first electric submersible pump 78*a* disposed to pump oil phase 100*a* to the surface and a second electric submersible pump 78*b* to inject water phase 100*b* through casing perforations 102*b* into a zone 76*b* of geological formation 76. In this embodiment, sensor 80*b* is disposed with electric submersible pump 78*b* and includes a flow rate meter and a pressure sensor. Fluid 100*b* may be injected into zone 76*b* to facilitate disposal of the water fraction and/or in as part of a tertiary production scheme, such as a water flood.

An embodiment of a method of surveillance of a wellbore is now described with reference to FIGS. 1 through 7. A pumping system 24 is deployed in a wellbore 74. In this embodiment pumping system 24 is provided to pump a wellbore fluid 100 into a zone of geological formation 76. Pumping system 24 may include a pump, such as electrical submersible pump (ESP) 78*b* to inject wellbore fluid 100 into zone 76*b* of formation 76. A sensor 80*b* is disposed in wellbore 74 proximate to injection zone 76*b* of geological formation 76. Sensor 80*b* may include one or more sensors which may be carried, for example as a module, in ESP pump 78*b*.

In this embodiment, sensor 80*b* includes a fluid flow rate sensor and a pressure sensor. Surveillance system 20 may accumulate data from sensor 80*b*. The data obtained at sensors 80*b* may be analyzed and processed, for example by control system 28, to determine a well parameter such as an injection performance parameter and/or capabilities of well 74. For example, well data sensed at sensor 80*b* may be utilized to generate and provide well information such as that represented by the Hall Plot illustrated in FIG. 8. A Hall plot may be displayed on user graphical interface 96 for example. In the illustrated embodiment of FIG. 8, line A indicates stable injection; line B may indicate negative skin and thus injecting above the formation parting pressure; line C may be indicative of channeling or out of zone 76*b* injection of fluid 100*b*; and line D may be indicative of a positive skin. System 20 may provide alerts and warnings to an operator and/or output control signals to well 74 and the associated devices in response to the collected data and interpretation of the data. A parameter or event may be selected and input such that upon receipt of data, for example from sensor 80*b*, or analysis of the received data that the selected parameter, set point, or threshold is encountered or exceeded that an alert is communicated to the operator and/or an output signal is communicated to pumping system 24 and/or a controllable device 82 to actuate an action.

Traditionally, injection fluids are pumped from the surface of the well down the wellbore and injected into the formation. Further, the injection pressure is often measured or sensed at the surface of the well. The illustrated embodiments provide pressure and flow rate data proximate to the injection zone 76*b* and therefore they may be more indicative of the injection capabilities of the formation and performance of the injection operations.

In the illustrated embodiment of FIG. 7 well 74 includes downhole separator 82*a* and production pump 78*a*. Output signals to well 74 in response to the data from sensors 80*b* may be directed to actuating downhole separator 82*a* and/or pump system 78*a*. For example, it may be desired to operate the systems to provide additional residence time to promote the separation of fluid portions 100*a* and 100*b*. It may be desired to increase or reduce the rate of production of fluid portion 100*a* via pump 78*a*.

In one embodiment of a method of operation, receipt of well data by sensor 80*b* may indicate that a selected well parameter of concern is being approached or exceeded. Analysis or processing of well data sensed by sensor 80*b* may provide a well parameter that is of concern. For example, injection fluid flow rate and/or injection pressure may be sensed by sensor 80*b*. This well data may be indicative of a well parameter, such as a high injection pressure, that corresponds to a threshold parameter of concern. In some embodiments, the sensed well data, for example, injection pressure, injection flow rate, and elapsed time, may be analyzed and processed to obtain a well parameter indicative of the injectivity or the like of the well or formation. Correlation of this obtained well parameter with a threshold parameter may indicative of an operational concern, such as those illustrated in FIG. 8. For example, the obtained well parameter may be indicative that a threshold parameter indicative of injection fluid 100*b* channeling has been exceeded. System 20 may communicate an alert signal to an operator that the selected threshold has been exceeded providing the operator the opportunity to take action to optimize the operation of the injection well 74 and/or communicate a signal to equipment of well 24 initiating an action. Provision of flow rate data and pressure data proximate to the injection zone may facilitate more accurate identification of injection and/or production concerns and facilitate more economic and mitigation actions.

In another example, a sensor 80, for example 80*b*, may sense well data indicating that the wellbore fluid being injected into the formation is primarily hydrocarbon based (fluid 100*a*) and is therefore not the desired produced water portion that is being injected. System 20 may communicate an alert to the operator that a threshold parameter indicative of the hydrocarbon, or oil, fraction of the injected wellbore fluid has been exceeded. System 20 may further communicate an output signal to controllable devices 82, including pump system 24 and pumps 78, actuating an action to mitigate the injection of the hydrocarbon fluid 100*a*. The action actuated may include without limitation, shutting down a pump such as pump 78*b*; changing the speed of one or more of pumps 78 and thus the fluid flow rate; increasing or decreasing the resident time of fluid 100 in downhole separator 82*a*; and operating one or more valves.

From the foregoing detailed description of specific embodiments of the invention, it should be apparent that systems and methods for monitoring and/or controlling wellbore operations that are novel have been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method comprising:

injecting a fluid through casing perforations into an injection zone of a formation penetrated by a wellbore in response to operating a pump in the wellbore;

sensing well data comprising injection pressure, injection flow rate, and elapsed injection time, wherein the injection pressure and the injection flow rate are sensed at the casing perforations into the injection zone;

receiving the sensed well data at a control device remote from the wellbore and connected to the wellbore by a two-way communication network, the control device being operable with a user interface via the two-way network;

determining a formation injection performance parameter in real-time using the received sensed well data, wherein the formation injection performance parameter comprises at least one selected from the group consisting of negative skin, positive skin, and water channeling; and outputting a signal in response to a correlation of a well parameter associated with the formation injection performance parameter and a corresponding preselected threshold well parameter associated with the formation performance parameter.

2. The method of claim 1, wherein the outputting a signal comprises communicating an alert to a remote location.

3. The method of claim 1, wherein the outputting a signal comprises communicating the signal to a controllable device actuating an action in the wellbore.

4. The method of claim 1, wherein the pump is an electric submersible pump.

5. The method of claim 1, wherein the determining the formation injection performance parameter comprises generating a Hall plot.

6. The method of claim 5, wherein the determining the formation injection performance parameters comprises displaying the generated Hall plot on the user interface.

7. The method of claim 1, further comprising:

operating a second pump disposed in a second wellbore to inject a fluid through casing perforations into a second injection zone of a formation penetrated by the second wellbore;

sensing second well data comprising injection pressure, injection flow rate, and elapsed injection time, wherein the injection pressure and the injection flow rate are sensed at the casing perforations into the second injection zone of the second wellbore;

receiving the sensed second well data at the control device; and determining formation injection performance parameters in real-time from the received second sensed well data, the formation injection performance parameters comprising at least one selected from the group consisting of negative skin and water channeling.

8. A method for surveillance of a well, the method comprising:

providing a first pumping system in a first wellbore that penetrates a formation;

providing a second pumping system in a second wellbore that penetrates a formation;

producing formation fluid from the respective formations into the respective wellbores;

injecting a fraction of each produced formation fluid from the respective wellbore through casing perforations into an injection zone of the respective formation via operation of the respective pumping system;

sensing well data comprising injection pressure, injection flow rate, and elapsed injection time at the casing perforations into the injection zones;

receiving at a control device the sensed well data from each of the injection zones, wherein the control device is remote from the first and the second wellbore and is operationally connected to each of the first and the second pumping systems by a two-way communication network, the control device operable with a user interface via the two-way communication network;

determining in real-time a formation injection performance parameter for each of the injection zones using the respective sensed well data, wherein the formation injection performance parameter comprises one selected from the group consisting of negative skin, positive skin, and water channeling; and outputting a signal in response to the sensed well data exceeding a preselected threshold well data parameter via the two-way communication network.

9. The method of claim 8, further comprising producing a fraction of the fluid from each of the wellbores.

10. The method of claim 9, wherein the produced fraction is a primarily oil fraction of the fluid and the injected fraction is a primarily water fraction of the fluid.

11. The method of claim 8, further comprising separating, in one of the wellbores, the produced formation fluid into a primarily oil fraction and a primarily water fraction.

12. The method of claim 11, wherein the pumping system comprises at least one electric submersible pump, the electric submersible pump injecting the primarily water fraction of the respective produced formation fluid into the injection zone.

13. The method of claim 8, wherein the outputting a signal comprises communicating an alert to a remote location.

14. The method of claim 8, wherein the outputting comprises communicating the signal to a controllable device actuating an action in at least one of the wellbores.

15. The method of claim 8, further comprising:

separating, in at least one of the wellbores, the produced formation fluid into a primarily oil fraction and a primarily water fraction, wherein the primarily water fraction is the fraction of the produced formation fluid injected into the injection zone by an electric submersible pump system of the pump system; and producing the primarily oil fraction of the produced formation fluid from the wellbore by a second pump of the pump system.

16. The method of claim 15, wherein the outputting a signal comprises communicating an alert to a remote location.

17. The method of claim 15, further comprising actuating an action in at least one of the wellbores in response to the outputting the signal.

18. The method of claim 8, wherein the determining the formation injection performance parameter comprises:

generating a Hall plot; and displaying the generated Hall plot on the user interface.

19. A method for surveillance of a well, the method comprising:

receiving at a pumping system disposed in a wellbore formation fluid produced into the wellbore;

injecting a fraction of the produced formation fluid through casing perforations into an injection zone of a formation via operation of the pumping system;

sensing well data comprising injection pressure, injection flow rate, and elapsed injection time, wherein the injection pressure and the injection flow rate are sensed at the casing perforations into the injection zone;

receiving at a control device the sensed well data, wherein the control device is remote from the wellbore and the control device is operationally connected to the pumping system by a two-way communication network, the control device operable with a user interface via the two-way communication network;

determining in real-time a formation injection performance parameter for the injection zone using the sensed well data, wherein the formation injection performance parameter comprises one selected from the group consisting of negative skin, positive skin, and water channeling; and outputting a signal in response to the sensed well data exceeding a preselected threshold well data parameter via the two-way communication network.

20. The method of claim 19, wherein the determining the formation injection performance parameter comprises:

generating a Hall plot; and displaying the generated Hall plot on the user interface.

* * * * *